US006282925B1

(12) United States Patent
Ando'

(10) Patent No.: US 6,282,925 B1
(45) Date of Patent: Sep. 4, 2001

(54) METHOD FOR MANUFACTURING CLOSED END TUBULAR ITEMS, IN PARTICULAR HOSIERY, ON A CIRCULAR KNITTING MACHINE

(75) Inventor: Jan Ando', Scandicci (IT)

(73) Assignee: Matec S.p.A., Scandicci (IT)

( * ) Notice: Subject to any disclaimer, the term of this patent is extended or adjusted under 35 U.S.C. 154(b) by 0 days.

(21) Appl. No.: 09/778,128

(22) Filed: Feb. 6, 2001

(30) Foreign Application Priority Data

Feb. 28, 2000 (IT) ..... MI20A0374

(51) Int. Cl.[7] ..... D04H 9/10; D04H 9/40
(52) U.S. Cl. ..... 66/17; 66/58; 66/148
(58) Field of Search ..... 66/17, 18, 19, 66/43, 147, 148, 58, 13, 149 S, 149 R, 150

(56) References Cited

U.S. PATENT DOCUMENTS 4,122,690 * 10/1978 Moreni ..... 66/14
5,231,856 * 8/1993 Lonati et al. ..... 66/147
5,570,591 * 11/1996 Frullini et al. ..... 66/58
5,924,309 * 7/1999 Conti ..... 66/148
6,105,399 * 8/2000 Frullini et al. ..... 66/148
6,158,252 * 12/2000 Conti ..... 66/148
6,164,091 * 12/2000 Frullini et al. ..... 66/148

FOREIGN PATENT DOCUMENTS

560614 * 9/1932 (DE) ..... 66/148

* cited by examiner

*Primary Examiner*—Danny Worrell
(74) *Attorney, Agent, or Firm*—Welsh & Katz, Ltd.

(57) ABSTRACT

The method consists in forming a tubular item on a circular machine by means of the needles of the needle cylinder, starting from the opposite axial end of the item with respect to the axial end to be closed and retaining on the needles of the needle cylinder the last formed row of knitting. The loops of the last row of knitting are then transferred individually to an auxiliary element provided with supporting elements for individually supporting the loops, and the supporting elements of at least one first half-row of the last row are suitable to receive two loops and to pass one of the two loops in the other loop. The item is furthermore reversed before and after the transfer. In a subsequent step, the loops of the second half-row are transferred from the corresponding supporting elements to the supporting elements engaged with the loops of the first half-row, and the loops of the second half-row are knitted in with the loops of the first half-row by passing the loops of the second half-row through the loops of the first half-row, thus closing the axial end of the item. Finally, an additional operation is performed in order to stabilize the closure of the item.

10 Claims, 5 Drawing Sheets

METHOD FOR MANUFACTURING CLOSED END TUBULAR ITEMS, IN PARTICULAR HOSIERY, ON A CIRCULAR KNITTING MACHINE

BACKGROUND OF THE INVENTION

The present invention relates to a method for manufacturing tubular items, particularly hosiery items, closed at an axial end, by means of circular hosiery knitting machines or the like.

It is known that hosiery items are generally manufactured on circular hosiery knitting machines and that in the conventional manufacturing method they are unloaded from the machine while their toe is still open and must be subjected to subsequent sewing or looping in order to form the finished product.

Since the sewing or looping operation requires a manual intervention of an operator to load the hosiery item on the looping or sewing machine, this operation has a significant effect on the overall manufacturing costs of hosiery items.

For this reason, methods and devices have been devised in recent years which are adapted to obtain hosiery items having a closed toe directly on the machine that manufactures them or are adapted to mechanize the transfer of the hosiery items from the machine that produces them to the looping or sewing machine in order to fully eliminate, or at least substantially reduce, manual interventions for performing this operation.

In some of these methods, for example in the method disclosed in Italian patent no. 1,277,396 in the name of the same Assignee, the hosiery item is started from the opposite end with respect to the toe, i.e., from the top of the leg, and is completed at the toe, retaining the last row of knitting on the needles of the machine. Said last row is then transferred, loop by loop, from the needles of the circular machine to the hooks supported by an annular element which is arranged around the upper end of the needle cylinder. The annular element is divided into two halves which can mutually overlap so as to overlap the loops of a half-row, carried by the hooks arranged in one half of the annular element, on the loops of the other half-row, which are supported by the hooks of the other half of the annular element. In a subsequent step, the pairs of loops thus arranged side by side are sewn in order to join them and thus close the toe of the hosiery item, which is then unloaded from the annular element.

The closure of the toe, performed with methods and devices of this kind, suffers the drawback that it is not fully satisfactory from an aesthetic point of view.

The joining of mutually adjacent pairs of loops by sewing in fact does not achieve a tight coupling of the loops that can be compared with the one obtainable by conventional sewing or looping.

SUMMARY OF THE INVENTION

The aim of the present invention is to solve the above problem by devising a method and an apparatus for manufacturing tubular items, particularly hosiery items, which are closed at an axial end and in which the closure of said axial end is fully satisfactory and comparable with the Closure that can be obtained by means of conventional sewing or looping operations.

Within this aim, an object of the invention is to provide a method which allows to manufacture tubular items, particularly hosiery items, which are closed at an axial end in a fully automated manner and therefore without requiring the manual intervention of an operator.

This aim and these and other objects which will become better apparent hereinafter are achieved by a method for manufacturing tubular items, particularly hosiery items, which are closed at an axial end by way of circular hosiery knitting machines or the like, which comprises a step for forming the tubular item on a circular machine by ways of the needles of the needle cylinder, starting from the opposite axial end of the item with respect to the axial end to be closed and retaining on the needles of the needle cylinder the last formed row of knitting, characterized in that it comprises the following additional steps:

individually transferring the loops of the last row of knitting formed by the needles of the needle cylinder to an auxiliary element provided with supporting means for individually supporting the loops, the supporting means of at least one first half-row of said last row being adapted to receive two loops and to pass one of the two loops in the other loop;

reversing the item;

transferring the loops of the second half-row of said last row from the corresponding supporting means to the supporting means engaged with the loops of the first half-row;

knitting in the loops of the second half-row with the loops of the first half-row by passing the loops of the second half-row through the loops of the first half-row and closing the axial end of the item;

performing an additional process in order to stabilize the closure of the item.

BRIEF DESCRIPTION OF THE DRAWINGS

Further characteristics and advantages of the invention will become better apparent from the description of a preferred but not exclusive embodiment of the method according to the invention, illustrated only by way of non-limitative example in the accompanying drawings, wherein.

DESCRIPTION OF THE PREFERRED EMBODIMENTS

Figure 2:
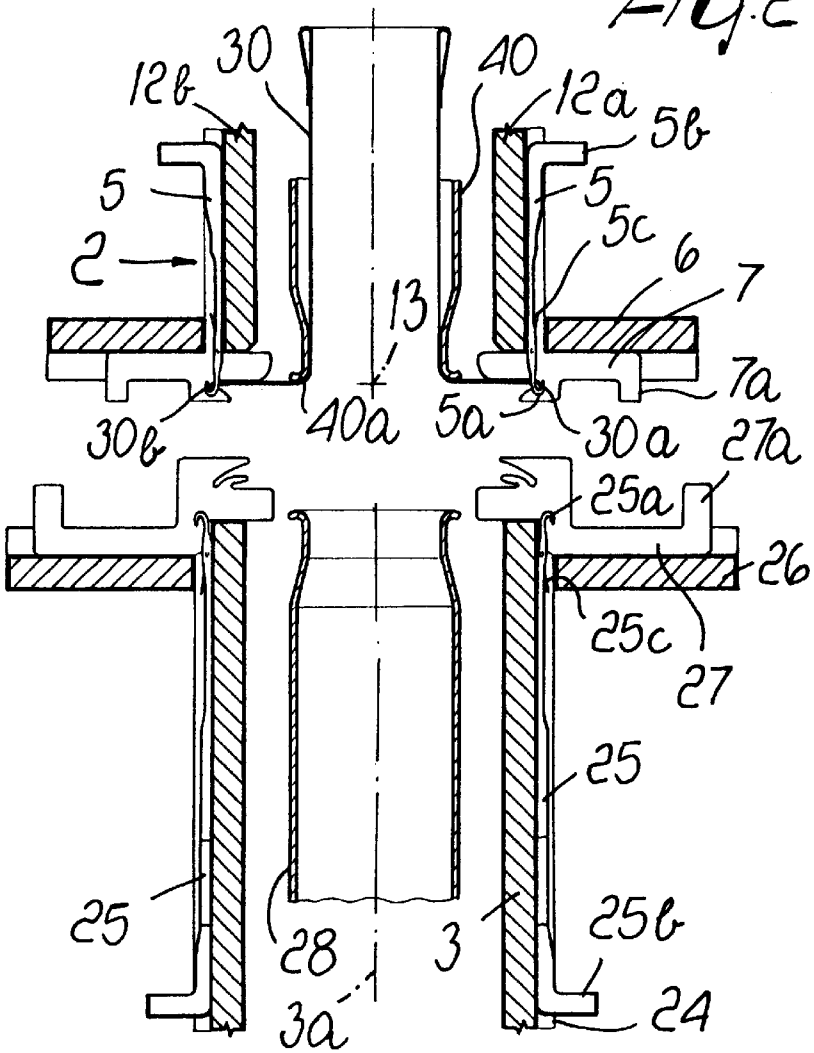
FIGS. 1 to 5 show schematically the execution of some steps of the method according to the invention with a particular auxiliary element constituted by an auxiliary needle cylinder.

With reference to the above figures, the method according to the invention comprises a step for manufacturing a tubular item 30 on a circular hosiery knitting machine or the like of the conventional type, i.e., as shown schematically in FIGS. 1 to 5, a machine provided with a needle cylinder 3 which has, on its side wall, a plurality of axial slots 24, each of which internally and slidingly accommodates a needle 25 which can be actuated in a per se known manner to form knitting.

The needle cylinder 3 is furthermore provided with a sinker ring 26 which has multiple radial slots which accommodate in a per se known manner sinkers 27 which can be actuated in order to cooperate with the needles 25 in forming knitting.

The needle cylinder 3 can be actuated with a rotary motion about its own axis 3*a* in a per se known manner with respect to cams which face the side wall of the needle cylinder 3 and form paths which can be engaged by the heels 25*b* of the needles 25 and with respect to cams which face in an upward region the sinker ring 26, are not shown for the sake of simplicity and form paths for the heels 27*a* of the sinkers 27, so as to achieve the actuation, in a per se known manner, of the needles 25 and of the sinkers 27 in order to form knitting.

A substantially cylindrical suction duct 28 is accommodated inside the needle cylinder 3 and coaxially thereto and can be connected to suction means in order to tension the item 30 during its manufacture.

The item 30 is produced with the needles of the circular hosiery knitting machine or the like starting from its opposite axial end with respect to the axial end to be closed and by retaining on the needles 25 of the needle cylinder 3 the last formed row of knitting loops 30*a*, 30*b*.

The loops 30*a*, 30*b* of the last row of knitting, formed by the needles 25 of the needle cylinder 3, are then individually transferred to an auxiliary element which is provided with supporting means for the individual support of the loops 30*a*, 30*b*. The means for supporting the loops 30*a* of at least one first half-row of the last row of knitting are suitable to receive two loops and to pass one of the two loops in the other loop.

Merely by way of example and only in order to better explain the method according to the invention, FIGS. 1 to 5 illustrate by way of example an auxiliary element which is constituted by an auxiliary needle cylinder 2, corresponding to an inverted needle cylinder which has a simplified structure with respect to the needle cylinder of conventional circular hosiery knitting machines.

The auxiliary needle cylinder 2 furthermore has, at its lower end, a sinker ring 6 which accommodates in a per se known manner a plurality of sinkers 7 which can be actuated in order to cooperate with the needles 5 in forming knitting.

The sinkers 7 can be actuated with a translatory motion toward or away from the axis 2*a* of the auxiliary needle cylinder 2 by way of appropriate cams, not shown for the sake of simplicity, which face in a downward region the sinker ring 6 and form paths for a heel 7*a* of the sinkers.

The needles 5 have at least one heel Sb which protrudes radially from the axial slots 4 of the auxiliary needle cylinder 2 and can engage cams which are arranged around the side wall of the auxiliary needle cylinder 2 and form paths for the heels Sb of the needles 5.

The auxiliary needle cylinder 2 can be actuated with a rotary motion about its own axis 2*a* with respect to the cams that form the paths for the heels Sb of the needles 5 and with respect to the cams that form paths for the heels 7*a* of the sinkers 7, so that the rotation of the auxiliary needle cylinder 2 about the axis 2*a* moves the needles 5 along the axial slots 4 of the auxiliary needle cylinder 2 in order to form knitting and for other operations described in greater detail hereinafter, and actuates the sinkers 7 toward or away from the axis 2*a* of the auxiliary needle cylinder 2 in order to cooperate with the needles 5 in forming knitting.

Differently from conventional needle cylinders, the auxiliary needle cylinder 2 is formed in two halves 12*a*, 12*b* which are mutually coupled on a diametrical plane which passes through the axis 2*a* of the auxiliary needle cylinder 2.

A first half 12*a* of the auxiliary needle cylinder 2, together with the corresponding cams for the actuation of the needles and of the sinkers, is pivoted to a supporting structure, not shown for the sake of simplicity, about an axis 13 which is parallel to a diametrical axis at right angles to the axis 2*a* of the auxiliary needle cylinder 2, so that it can be rotated on command about said axis 13 in order to move the needles 5 that belong to the first half 12*a* so that they face from below, with their tip 5*a*, the tip 5*a* of the needles 5 supported by the second half 12*b* of the auxiliary needle cylinder 2.

Figure 1:
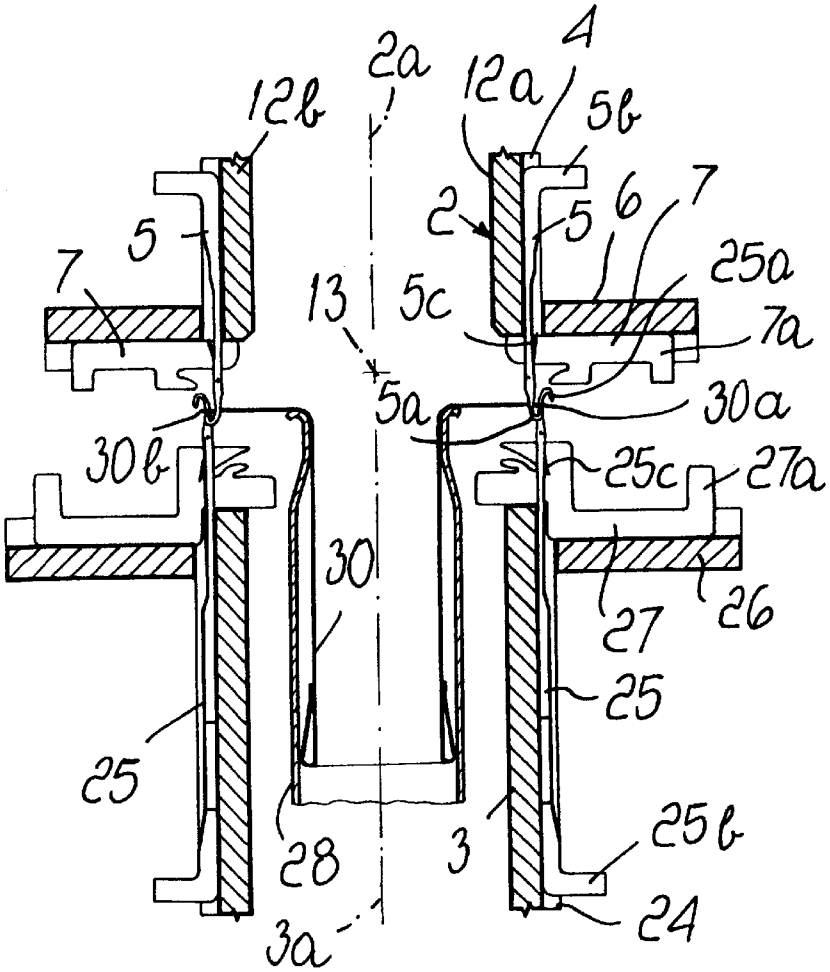

After the needles 25 of the needle cylinder 3 have formed the last row of knitting, retaining the loops 30*a* and 30*b* of the two half-rows that form said last row, the auxiliary cylinder 2 is arranged above and coaxially with respect to the needle cylinder 3 and the loops 30*a* of the first half-row are transferred to the needles 5 located in the first half 12*a*, which cannot turn over, of the auxiliary needle cylinder 2, while the loops of the second half-row 30*b* are passed individually from the needles 25 to the needles 5 that belong to the second half 12*b*, which can turn over about the axis 13, of the auxiliary needle cylinder 2, as shown in FIG. 1.

The loops can be transferred from the needles 25 to the needles 5 by lowering the needles 5, which are conveniently arranged along a cylinder whose diameter is smaller than the cylinder along which the needles 25 are arranged, toward the needles 25, so that the tip 5*a* of the needles 5 enters the loop of knitting retained on the needles 25. The needles 25 are then raised so that their tongue 25*c* moves beyond said last loop and are then lowered so as to permanently release said loop of knitting.

The item 30 is then reversed inside the auxiliary needle cylinder 2 by virtue of suction applied to a suction duct 40 which is arranged internally and coaxially with respect to the needle cylinder 2 and has an inlet 40*a* proximate to the lower end of the auxiliary needle cylinder 2, as shown in FIG. 2.

It should be noted that the item 30 can be reversed either before or after its transfer from the needle cylinder 3 to the auxiliary needle cylinder 2.

At this point, the auxiliary needle cylinder 2 can be moved away from the needle cylinder 3 and the second half 12*b* of the auxiliary needle cylinder is turned about the axis 13 in order to move the needles 5 of the second half 12*b* so that they face, with their tip 5*a*, the tip Sa of the needles 5 that belong to the first half 12*a*.

Figure 3:
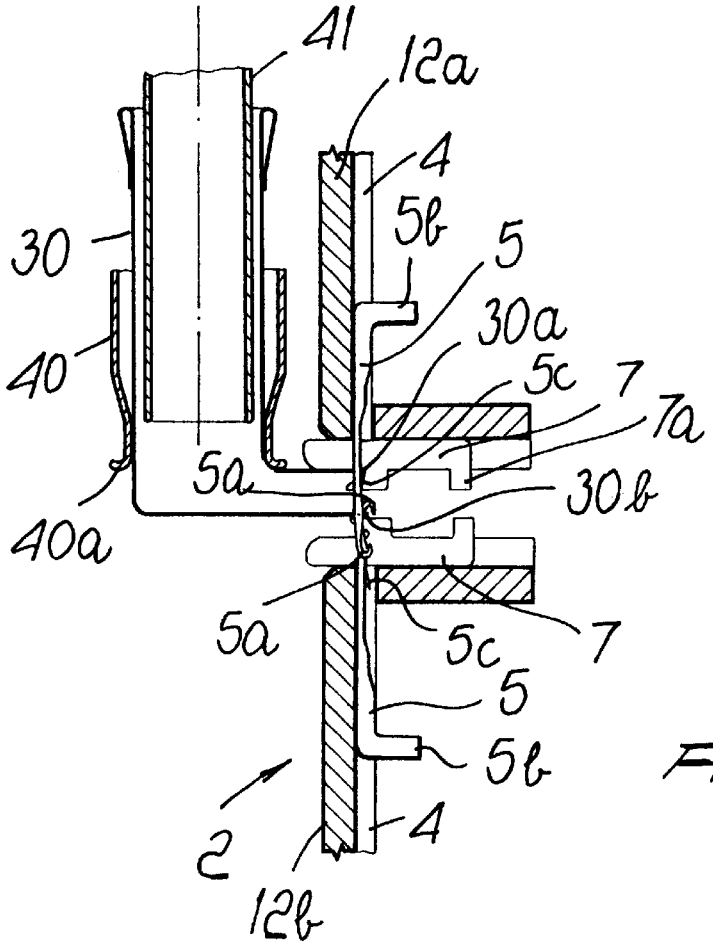
Figure 4:
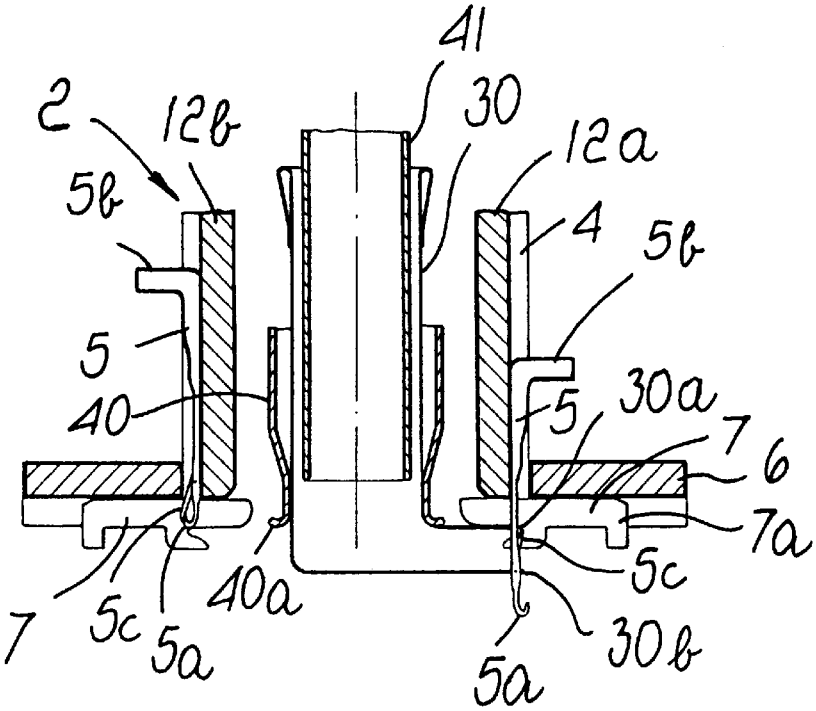

In a subsequent step, the loops 30*b* of the second half-row are transferred from the corresponding supporting means, constituted by the needles 5 that belong to the second half 12*b* of the auxiliary needle cylinder 2, to the supporting means that are engaged with the loops 30*a* of the first half-row and are constituted, in the illustrated embodiment, by the needles 5 that belong to the first half 12*a* of the auxiliary needle cylinder 2, as shown in FIG. 3. It should be noted that the loops 30*b* of the second half-row are engaged by the needles 5 of the first half 12*a* of the auxiliary needle cylinder 2, while the loops 30*a* of the first half-row are passed above the tongue 5*c* of the needles 5, as shown in FIG. 4.

Figure 6:
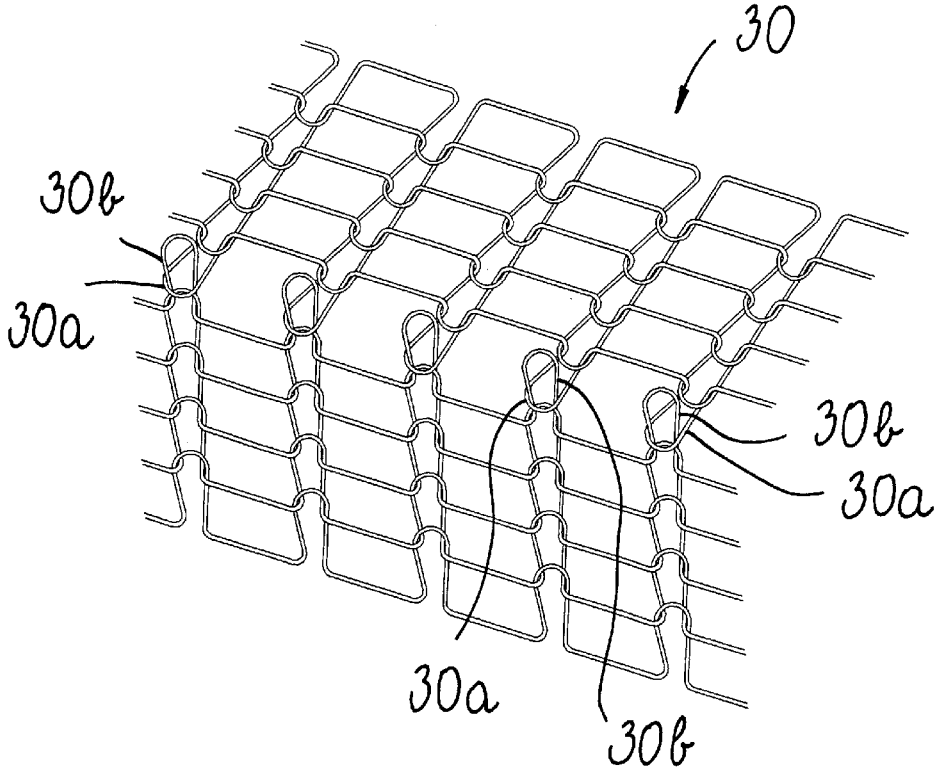
FIG. 6 shows the knitting-in of the loops of knitting of the second half-row with the loops of knitting of the first half-row.

In a subsequent step, the loops 30*b* of the second half-row are knitted in with the loops 30*a* of the first half-row, passing the loops 30*b* of the second half-row through the loops 30*a* of the first half-row, as shown in FIG. 6. This operation in practice closes the axial end of the item 30.

In a subsequent step, an additional process is performed so as to stabilize the closure of the item 30.

Figure 7:
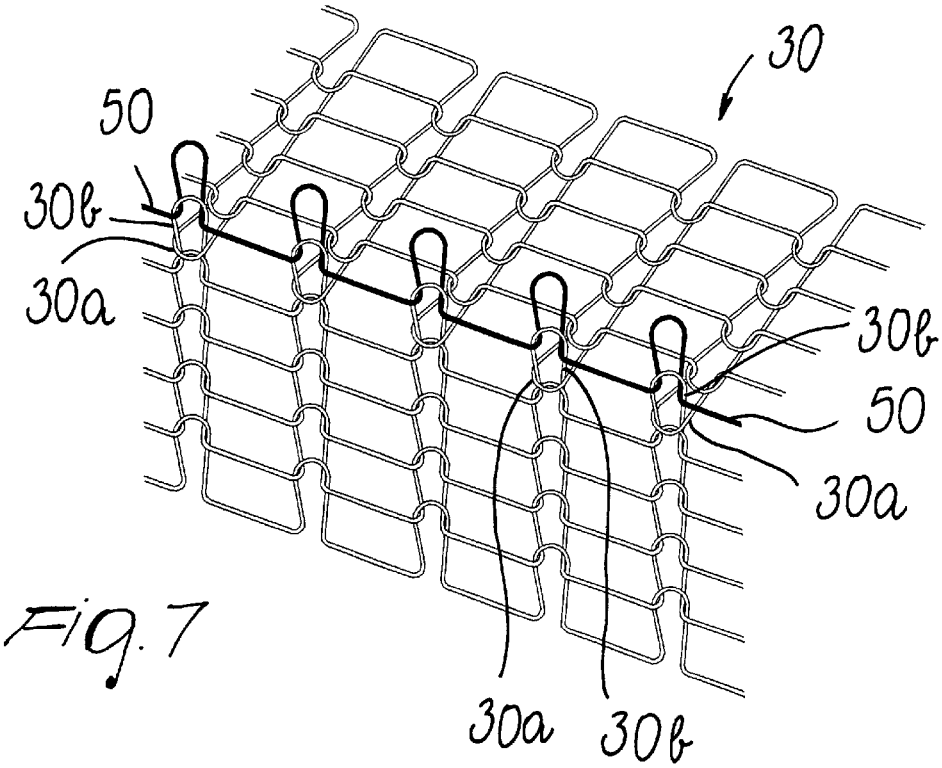
FIGS. 7 to 10 show some possibilities of execution of the additional process for stabilizing the closure of the item.

As shown in particular in FIG. 7, said additional process can simply consist in the forming of at least one additional row of knitting 50, which is knitted in with the loops of the second half-row of knitting 30*b* after they have passed through the loops 30*a* of the first half-row.

Conveniently, the additional row of knitting 50 can be provided by means of a thread made of heat-sensitive material, preferably a thread made of a heat-activated adhesive substance of a known type, which is subsequently heated so as to stably adhere to the loops 30*b*, thus making them non-run.

Figure 8:
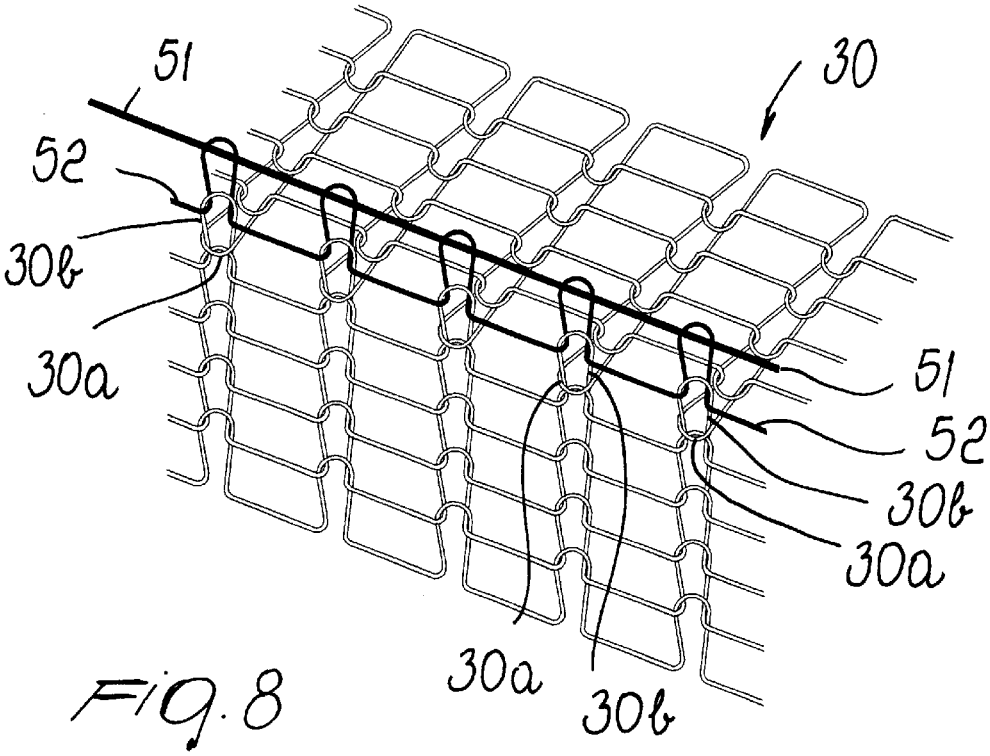

As an alternative, the additional process can comprise the sewing of the loops 30*b* of the second half-row, after their passage through the loops 30*a* of the first half-row, with two threads 51 and 52, as shown in FIG. 8. Said sewing can be performed, in a per se known manner, by means of a sewing head which cooperates with the needles 5 that belong to the first half of the auxiliary needle cylinder 2.

Figure 9:
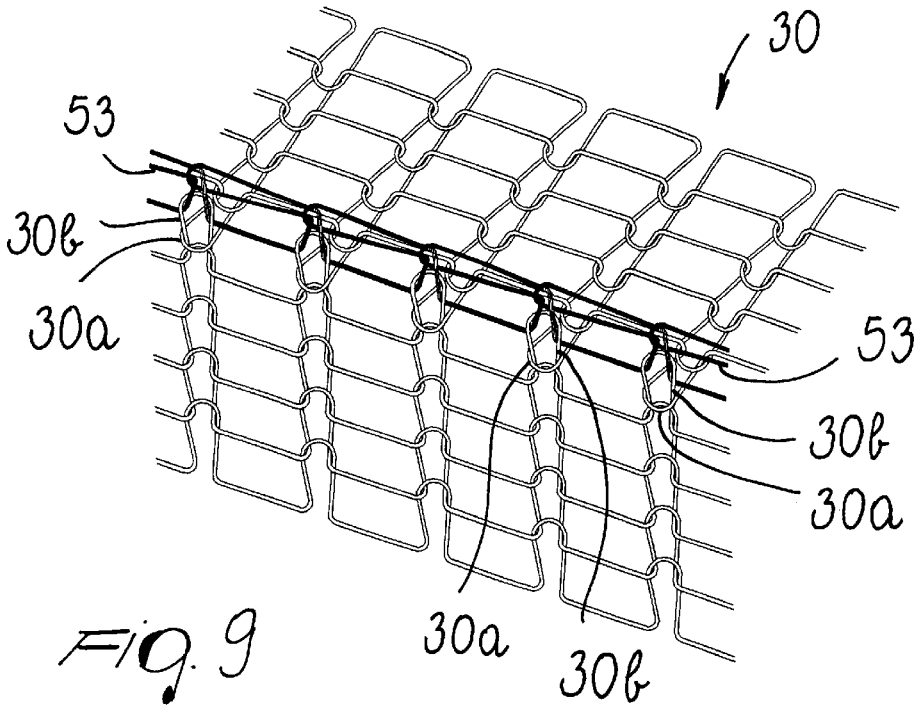
Figure 10:
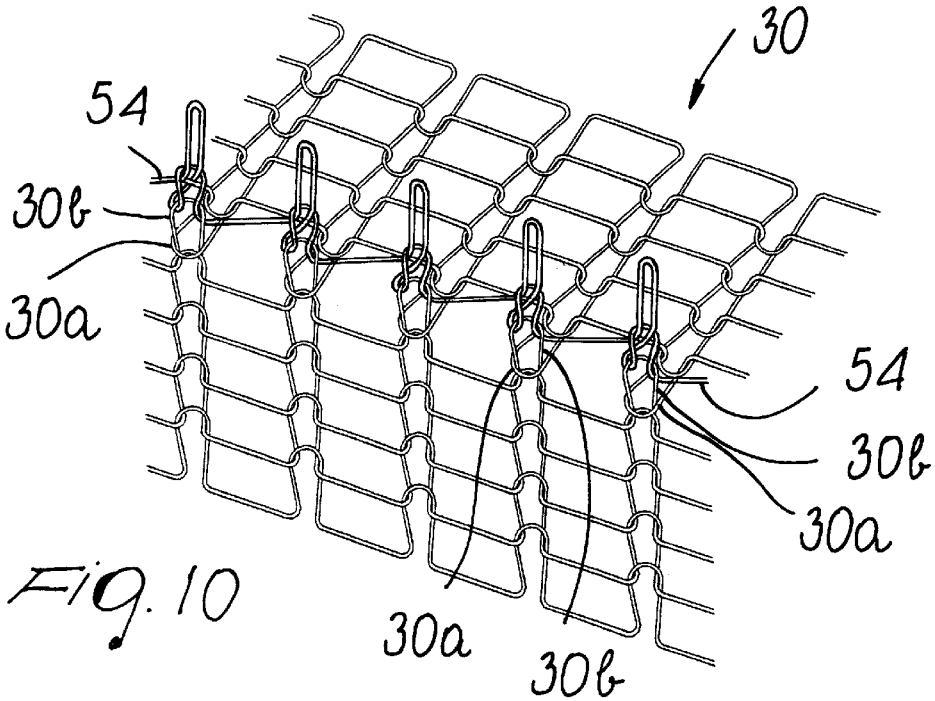

The additional process can also be constituted by the forming of a chainstitched seam with a single thread 53 which mutually connects the loops 30*b* of the second half-row after their passage through the loops 30*a* of the first half-row, as shown in FIG. 9. Said chain-stitched seam can also be formed by way of a known type of sewing head which cooperates with the needles 5 that belong to the first half 12*a* of the auxiliary needle cylinder 2.

The additional process can also comprise the forming of at least one row of non-run knitting 54 knitted in with the loops 30*b* of the second half-row after their passage through the loops 30*a* of the first half-row. Said row of non-run knitting can be formed, as disclosed in Italian patent no. 1,286,282 in the name of the same Assignee, by using a half-dial or dial provided with hooks which face the needles that belong to the first half 12*a* of the auxiliary needle cylinder 2, or by using the needles 5 of the second half 12*b* of the auxiliary needle cylinder 2, which are appropriately offset laterally with respect to the needles 5 that belong to the first half 12*a* of the auxiliary needle cylinder 2.

It should be noted that instead of transferring the loops 30*a* from the needles 5 that belong to the second half 12*b* of the auxiliary needle cylinder to the needles 5 that belong to the first half 12*a* of the auxiliary cylinder 2 it is possible to transfer the loops 30*a* of the first half -ro w to the needles 5 of the second half 12*b* which already carry the loops 30*b* of the second hal-frow. In this case, the needles 5 that belong to the second half 12*b* of the auxiliary needle cylinder pass the loops 30*a* through the loops 30*b*, closing the axial end of the item 30, and are used to perform the additional processes for stabilizing the closure of the item 30 as an alternative to the needles of the first half 12*a* of the auxiliary needle cylinder. In practice, with the method according to the invention, by virtue of the fact that the closure of an axial end of the item is performed by passing the loops of one half-row of the last formed row of knitting through the loops of the other half-row, one achieves a compact closure which is fully satisfactory from an aesthetic point of view.

Figure 5:
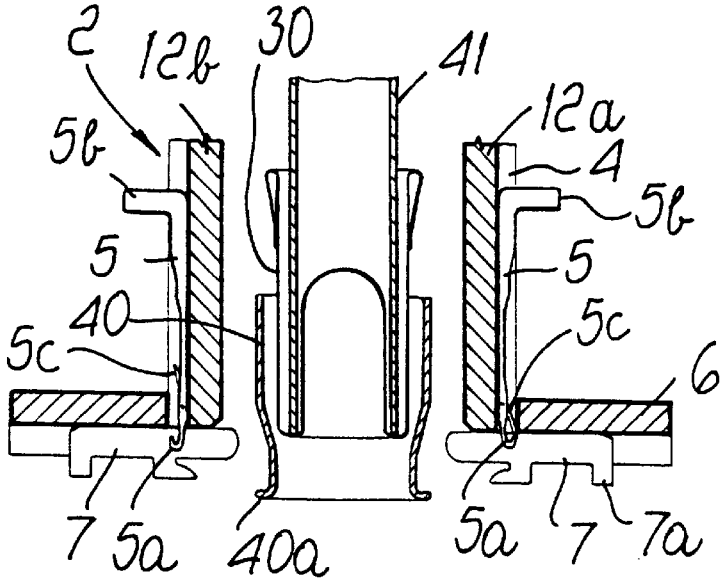

At the end of the additional process for closure stabilization, the item 30, closed at one of its axial ends, is released by the needles 5 and is aspirated, starting from the closed axial end, into a second suction duct 42 which is arranged inside the suction duct 41, as shown in FIG. 5. By virtue of this suction, the item 30 is reversed again and is unloaded from the machine "right way out".

It should be noted that the method according to the invention has been described with reference to the use of an auxiliary element which is constituted by an auxiliary needle cylinder, but the auxiliary element can be constituted by any other element capable of individually receiving the loops of the last row of knitting formed by the needles of a needle cylinder and of transferring the loops that belong to one half-row of said last row inside the loops of the other half-row.

Furthermore, the passage of the loops of the last row formed on the circular hosiery knitting machine or the like can be performed directly or by means of an intermediate transfer element, such as for example a half-dial or a dial provided with hooks which can receive and release loops of knitting, such as for example the annular element disclosed in Italian patent no. 1,277,396 in the name of the same Assignee.

In practice it has been found that the method according to the invention fully achieves the intended aim, since by closing an item at one of its axial ends by passing the loops that belong to one half-row inside the loops of the other half-row of the last row of knitting formed on the machine that manufactures the item, one achieves a compact closure of an axial end of the item which is fully satisfactory from an aesthetic point of view.

Another advantage of the method according to the invention is that the item is closed at one of its axial ends by acting on the reverse side of the item, thus obtaining all the more an excellent result from an aesthetic point of view.

The method thus conceived is susceptible of numerous modifications and variations, all of which are within the scope of the appended claims; all the details may furthermore be replaced with other technically equivalent elements.

In practice, the materials used, as well as the dimensions, may be any according to requirements and to the state of the art.

The disclosures in Italian Patent Application No. MI2000A000374 from which this application claims priority are incorporated herein by reference.

What is claimed is:

1. A method for manufacturing knitted tubular items, which are closed at an axial end by way of a circular knitting machine, comprising the steps of:

forming the tubular item on a circular machine by way of needles of a needle cylinder thereof, starting from an opposite axial end of the item with respect to an axial end to be closed;

retaining on the needles of the needle cylinder a last formed row of knitting;

individually transferring loops of the last row of knitting formed by the needles of the needle cylinder to an auxiliary element provided with supporting means for individually supporting the loops, the supporting means of at least one first half-row of said last row being adapted to receive two loops and to pass one of said two loops in the other loop;

reversing the item;

transferring the loops of a second half-row of said last row from corresponding ones of said supporting means to the supporting means of the loops of the first half-row;

knitting in the loops of the second half-row with the loops of the first half-row by passing the loops of the second half-row through the loops of the first half-row and closing the axial end of the item; and performing an additional operation for stabilizing closure of the item.

2. The method of claim 1, wherein in the reversing step the item is reversed before transferring the loops of the last row of knitting formed on the needle cylinder to the auxiliary element.

3. The method of claim 1, wherein in the reversing step the item is reversed after transferring the loops of the last row of knitting formed on the needle cylinder to the auxiliary element.

4. The method of claim 1, wherein said additional operation comprises forming of at least one additional row of knitting which is knitted in with the loops of the second half-row after passage thereof through the loops of the first half-row.

5. The method of claim 4, wherein said at least one additional row of knitting is formed with a thread of heat-sensitive material.

6. The method of claim 5, wherein said thread of heat-sensitive material is made of a heat-activated adhesive substance.

7. The method of claim 4, wherein said additional operation comprises sewing of the loops of said second half-row after their passage through the loops of said first half-row.

8. The method of claim 4, wherein said additional operation comprises chain-stitching the loops of said second half-row after their passage through the loops of said first half-row.

9. The method of claim 4, wherein said additional operation comprises execution of at least one row of non-run knitting which is knitted in with the loops of said second half-row after passage thereof through the loops of said first half-row.

10. A tubular knitted item closed at one axial end thereof, obtained with the method of claim 1.

* * * * *